US006858175B2

(12) United States Patent
Saarinen et al.

(10) Patent No.: US 6,858,175 B2
(45) Date of Patent: Feb. 22, 2005

(54) BOTTOM STRUCTURE FOR A SMELTING FURNACE

(75) Inventors: Risto Saarinen, Espoo (FI); Ilkka Kojo, Kirkkonummi (FI)

(73) Assignee: Outokumpu Oyj, Espoo (FI)

( * ) Notice: Subject to any disclaimer, the term of this patent is extended or adjusted under 35 U.S.C. 154(b) by 85 days.

(21) Appl. No.: 10/344,828

(22) PCT Filed: Aug. 17, 2001

(86) PCT No.: PCT/FI01/00730

§ 371 (c)(1),
(2), (4) Date: Feb. 14, 2003

(87) PCT Pub. No.: WO02/14765

PCT Pub. Date: Feb. 21, 2002

(65) Prior Publication Data

US 2003/0173722 A1 Sep. 18, 2003

(30) Foreign Application Priority Data

Aug. 18, 2000 (FI) ..... 20001827

(51) Int. Cl.[7] ..... C21B 7/02

(52) U.S. Cl. ..... 266/286; 266/280; 266/283

(58) Field of Search ..... 266/280, 281, 266/282, 283, 285, 286

(56) References Cited

U.S. PATENT DOCUMENTS

| | | | | |
|---|---|---|---|---|
| 4,088,310 A | | 5/1978 | Noponen et al. | 266/162 |
| 4,325,538 A | | 4/1982 | Wozniczko et al. | 266/190 |
| 4,428,731 A | * | 1/1984 | Maes et al. | 266/285 |
| 4,773,630 A | | 9/1988 | Carminati et al. | 266/285 |

FOREIGN PATENT DOCUMENTS

| | | |
|---|---|---|
| DE | 34 05 462 A1 | 8/1984 |
| EP | 0 499 956 B1 | 5/1996 |

* cited by examiner

*Primary Examiner*—Scott Kastler
(74) *Attorney, Agent, or Firm*—Morgan & Finnegan, LLP

(57) ABSTRACT

The invention relates to a bottom structure of a suspension smelting furnace to be used in a smelting furnace (1), in the reaction space (2) whereof of sulfidic raw material containing metal, such as copper, nickel or lead, is smelted in the presence of an oxygen-bearing gas and slag-forming agent, in order to render the metal in a form that is advantageous for further treatment, and where the created molten phases (5, 6) are settled onto the bottom (3) of the smelting furnace in order to separate the molten phases form each other, when the temperature of the molten phases is within the range 1150–1450° C. According to the invention, the bottom structure includes at least one arched lining layer (7) inclined in the longitudinal direction of the smelting furnace, so that the temperature on the surface (89 that is opposite to the surface that gets into contact with the molten phase is below 800° C.

7 Claims, 3 Drawing Sheets

BOTTOM STRUCTURE FOR A SMELTING FURNACE

Figure 1:
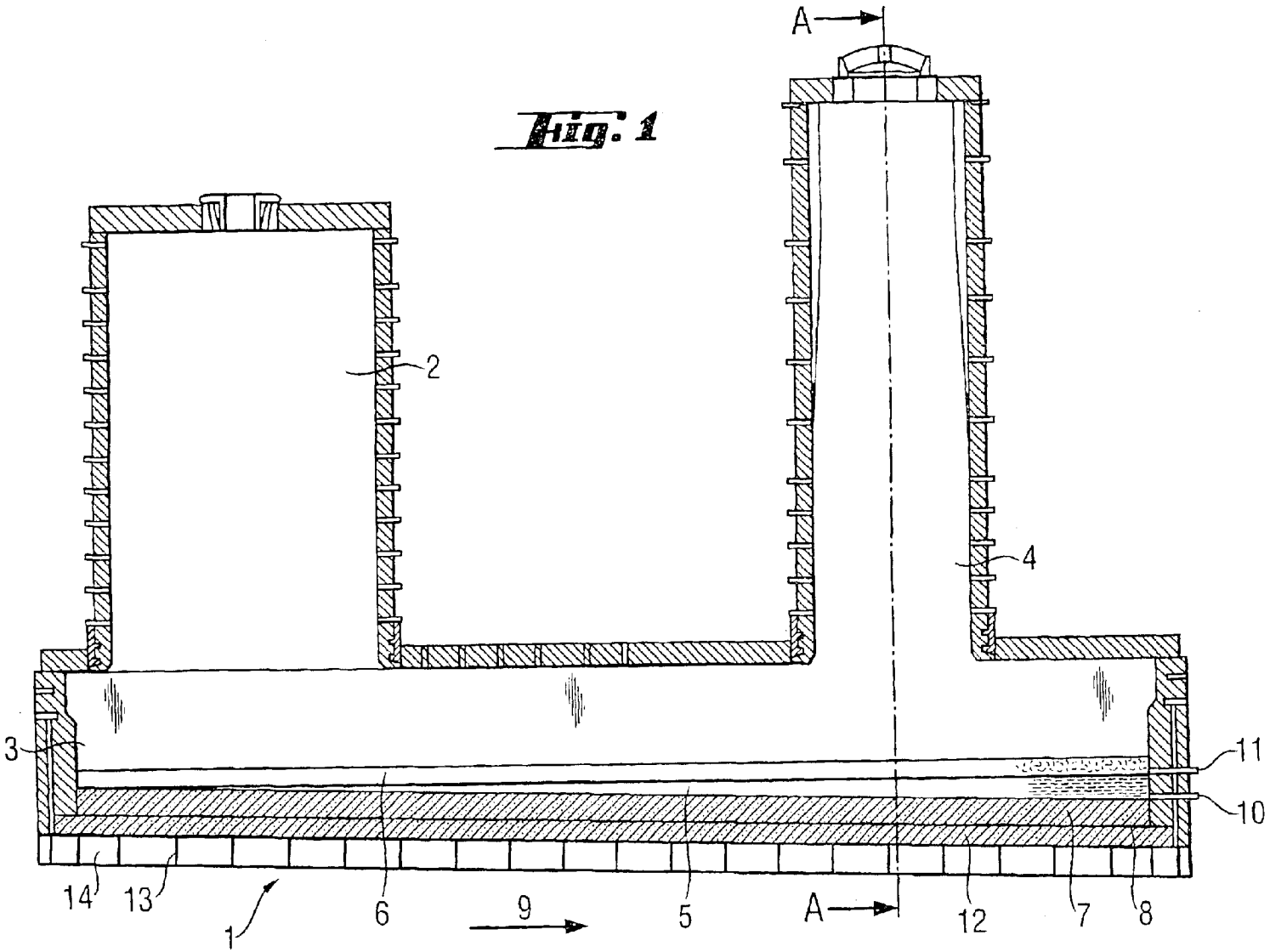

The present invention relates to a bottom structure for a suspension smelting furnace, by means of which structure the harmful access of metal-containing compounds with essentially low melting temperatures to the various layers of the bottom structure is prevented.

Generally a suspension smelting furnace comprises a reaction shaft, a settler and an uptake shaft. Advantageously the metal to be smelted is fed to the reaction shaft of the suspension smelting furnace as a sulfidic metal concentrate together with oxygen-bearing reaction gas, flue dust obtained from the cleaning of the furnace exhaust gases and recirculated, and with a slag-forming agent. As a result of the reactions taking place in the uptake shaft, there are created at least two molten phases, slag and metal matte, which are settled in the settler of the suspension smelting furnace. Now, when the metal is for instance copper, the slag temperature is within the range 1200–1450° C. and the matte temperature is within the range 1150–1300° C. Molten phases that have a high temperature are removed in molten state through holes made in the settler walls. In addition, as a result of the reactions taking place in the reaction shaft, there are created exhaust gases, which are conducted to the uptake shaft of the suspension smelting furnace and further to the cleaning of gases.

When manufacturing in a suspension smelting furnace by using metal concentrate for example copper matte with a copper content within the range 60–78%, it is possible that part of the copper from time to time forms metal matte, where the activity of metallic copper is near the value 1. As a consequence, it is possible that there begins to form a metal phase precipitating from the matte. The formation of the metal phase is particularly likely if the metal matte contains, in addition to copper, large amounts of so-called speise agents, such as arsenic, antimony, bismuth and lead. In that case, when operating near the activity value 1 of metallic copper, part of the metallic phase may begin to precipitate from the phase already before the metallic copper is created. The melting point of said metallic speise is low, at lowest only about 800° C., which is a great deal lower than the melting point 1083° C. of metallic copper. Owing to its specific weight, which is larger than that of matte, said speise is settled on the bottom of the smelting furnace, between the bottom lining and the matte phase. Moreover, said metallic speise has a low viscosity, so that the metallic speise has a chance, when penetrating to the fireproof material of the bottom of the suspension smelting furnace, to proceed—according to the temperature distribution of the bottom structure—remarkably deeper than for instance metallic copper. It is also pointed out that particularly when penetrating to the pores of the lining bricks of the smelting furnace, the speise weakens the insulating capacity of the bricks, and consequently weakens the temperature profile of the lining with respect to its permeability to metallic material. This results in the danger that the bottom of the suspension smelting furnace could be weakened, because the created metallic speise penetrates through the topmost lining layer and even through several lining layers, as well as through the junctions of the lining bricks, and is even impregnated in the ceramic lining material.

In case the metallic speise penetrates to the various layers of the bottom structure of the suspension smelting furnace, the buoyant force directed to the brick layer or brick layers by the metallic speise conforms to the Archimedean principle, and owing to the large difference in density between the molten material and the lining material, to the lining there is directed an essentially strong force that tends to lift off the whole lining structure located above it. In general, the effects of the buoyant force are prepared to by arching the furnace bottom in a low-gradient U-form, so that the bottom has a given radius of curvature in one direction. On the other hand, this shape results in that when letting the produced matte out of the suspension smelting furnace, particularly through the tap holes placed on the side walls, on the furnace bottom there is left a permanent layer with a low turnover factor. Particularly when metallic speise is formed, the bottom structure of the suspension smelting furnace gets into a long-term contact with metallic speise, which now has ample time to penetrate into the lining.

The object of the present invention is to eliminate some of the drawbacks of the prior art and to achieve an improved bottom structure for a suspension smelting furnace, which structure advantageously prevents a possible molten, metallic speise from penetrating into the various layers of the bottom structure. The essential novel features of the invention are apparent from the appended claims.

The bottom structure of a suspension smelting furnace according to the invention is used in a suspension smelting furnace where sulfidic raw material metal containing metal, such as copper, nickel or lead, is smelted in order to render said metal in an form that is advantageous for further treatment. The molten matte, slag and possible raw metal phase created in the reaction space of the suspension smelting furnace are conducted onto the bottom of the suspension smelting furnace in order to separate the different phases from each other. The suspension smelting furnace bottom structure according to the invention is composed of at least one arched lining layer that is inclined in the longitudinal direction of the suspension smelting furnace, so that the molten phases can be conducted to towards the molten phase tap holes. The arched lining layer is further reinforced by means of a steel structure that is arched in a similar way. Between the arched lining layer and the steel structure, there can be provided at least one additional lining layer that lowers the heat influences directed to the steel structure.

In the suspension smelting furnace bottom structure according to the invention, the tap hole of the molten phase that is formed lowest is arranged on the level of the arched lining layer that is contact with the molten phase, so that the molten phase tap hole is essentially arranged at the lowest point of the arched bottom structure. The arched lining layer that gets into contact with the molten phase placed in the suspension smelting furnace is made so that the temperature of the surface that is opposite to the surface in contact with the molten phase is below 800° C. This prevents the metallic phase, speise, that is possibly created in the smelting process and has a low melting point, from penetrating through the lining layer.

In the bottom structure of a suspension smelting furnace according to the invention, the arched lining layer, provided in the suspension smelting furnace bottom structure, that gets into contact with the molten phase is made of a material constituting burnt brick, such as magnesium oxide bearing brick. The thermal conductivity of the material of the arched lining layer is advantageously over 2 W/mK, and the material porosity is advantageously below 20%. Depending on the temperature of the molten phase that gets into contact with the bottom structure, the lining layer thickness is within the range 250–700 millimeters, advantageously 350–600 millimeters. Thus the temperature of the surface opposite to the surface that gets into contact with the molten phase of the lining layer of the bottom structure is maintained at a desired temperature, below 800° C. In addition, the arched lining layer that gets into contact with the molten phase of the bottom structure is arranged in an inclined position with respect to the horizontal level, so that the inclination is, depending on the viscosity of the molten phase placed in the suspension smelting furnace, within the range 0.1–4%, advantageously 0.2–2%.

The lining layer and possible additional lining layer or layers provided in the bottom structure of the suspension smelting furnace according to the invention and being in contact with the molten phase located on the bottom of the suspension smelting furnace, as well as the steel structure reinforcing the bottom structure are made to be arched. In addition, the separate layers are made so that each layer is essentially even in thickness throughout the whole width of the suspension smelting furnace. Now the influence of the temperature is distributed in an essentially even manner to the whole of said layer. Further, the influence of the temperature to the steel structures used for reinforcing the bottom structure and at the same time serving as the outer wall of the bottom structure can advantageously be reduced by conducting cooling gas, such as air, from outside the suspension smelting furnace, to the cooling channels arranged in the steel structure.

Figure 2:
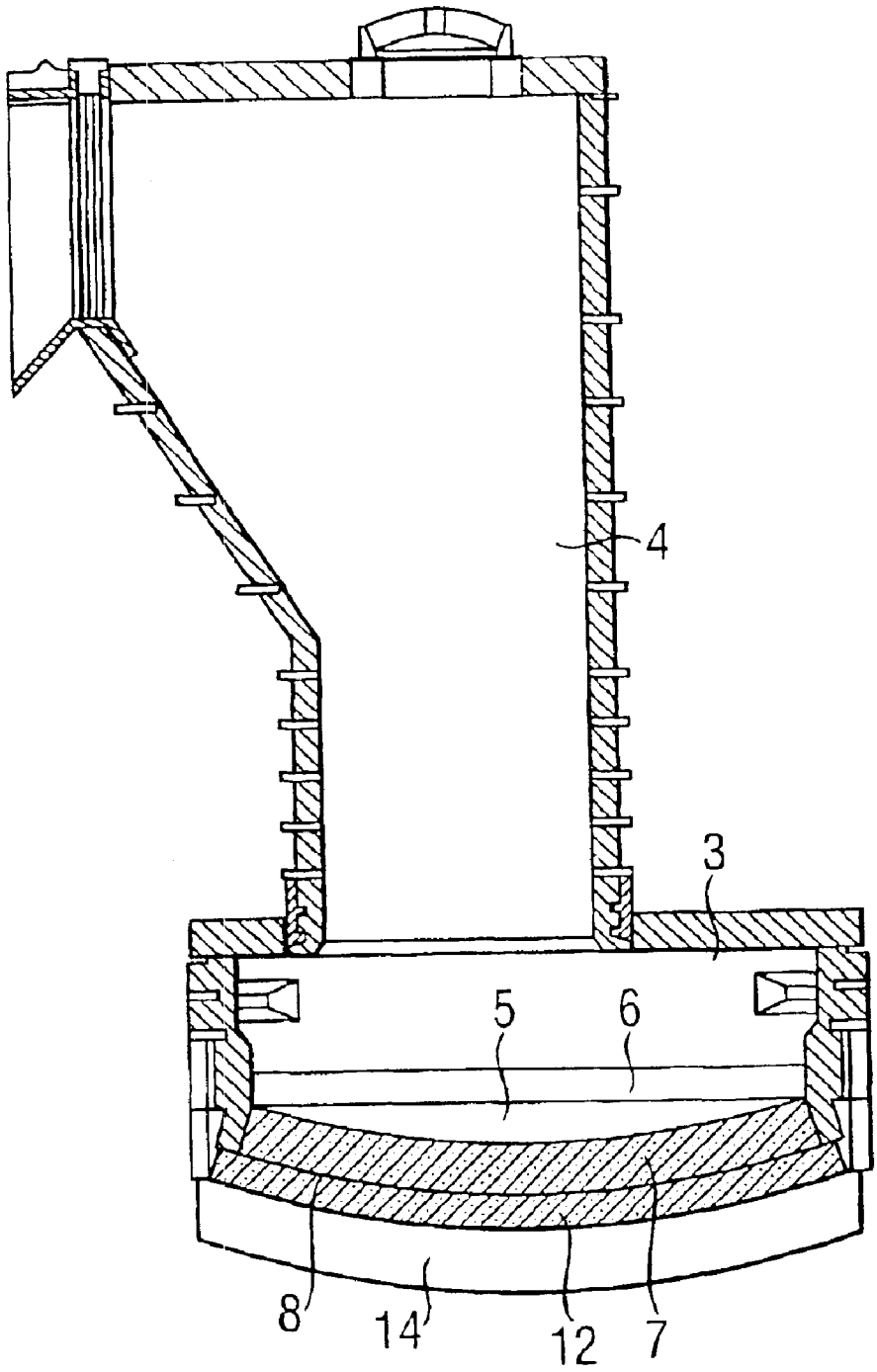
Figure 3:
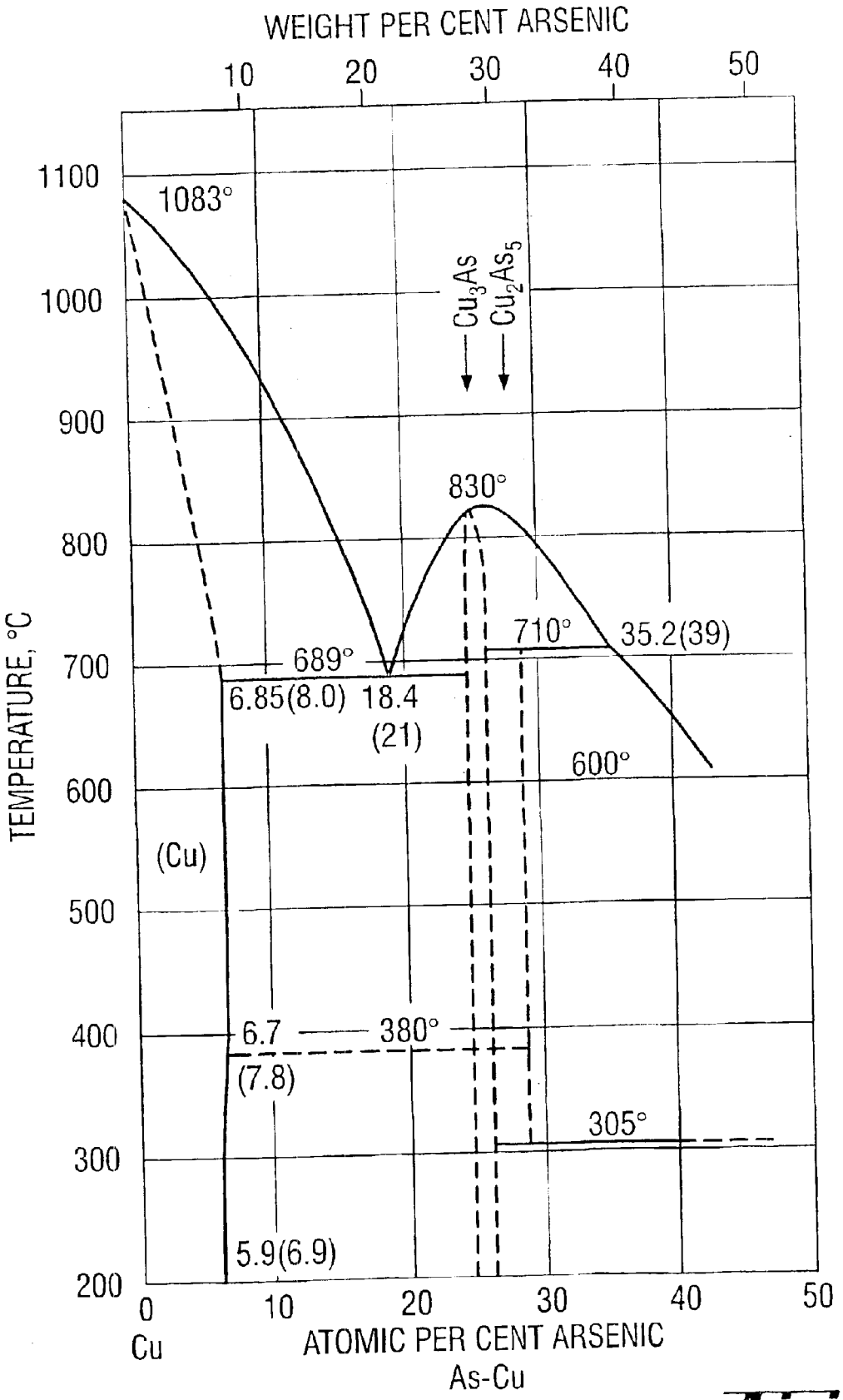

The invention is explained in more detail with reference to the appended drawings, where FIG. 1 illustrates a preferred embodiment of the invention, seen in a side-view cross-section, FIG. 2 illustrates the embodiment of FIG. 1, seen in the direction A—A, and FIG. 3 is phase diagram between copper and arsenic.

In the embodiment according to FIGS. 1 and 2, into the top part of the reaction shaft 2 of the suspension smelting furnace 1, there is fed copper-bearing sulfidic concentrate, oxygen-bearing gas, slag-forming agent and flue dust separated from the exhaust gases of the suspension smelting furnace, which materials react with each other in the reaction shaft 1. The molten phases, the matte phase 5, the slag phase 6 and possible speise created in the reactions are settled in the settler 3 of the suspension smelting furnace in order to be separated of each other. On the other hand, the exhaust gases created in the reactions are conducted, via the settler 3, to the uptake shaft 4 of the suspension smelting furnace and further to the cleaning of gases.

In case arsenic is involved in the copper-bearing sulfidic concentrate, as a result of the reactions in the reaction shaft 2, there may be created speise, which in composition corresponds essentially to the compound $Cu_3As$ that has a melting point at about 830° C. according to the phase diagram of FIG. 3. Speise can also be created by precipitating from the matte phase in the settler 3.

In order to eliminate the influence of the speise that has a low melting point, on the bottom of the settler 3 of the suspension smelting furnace, there is arranged an arched lining layer 7 made of magnesium oxide bearing brick material . The porosity of the bricks in the lining layer 7 is below 20%, the thermal conductivity is over 2 W/mK and the thickness is 450 mm, in which case the obtained temperature distribution for the lining layer 7 is that the temperature of the lining layer 7, on the surface opposite to the surface that gets into contact with the molten matte phase 8, is below 800° C. This prevents the penetration of the possibly created speise that has a low melting temperature through the lining layer 7. Moreover, the lining layer 7 is inclined, according to the flowing direction 9 of the molten phases, by 2% with respect to the horizontal level. On the wall of the settler 3, at the lower end of the lining layer 7, essentially in the lowest spot of the arched structure, there is provided a tap hole 10 of the matte phase 5. In the wall of the settler 3, above the tap hole 10 of the matte phase 5, there also is provided a tap hole 11 for the slag phase 6. By means of inclining the lining layer 7, and by adjusting the position of the tap hole 10 of the matte phase 5, the penetration of the possible speise to the lining is further reduced.

Underneath the lining layer 7, in the settler 3, there also is arranged an arched additional lining layer 12, the top surface whereof corresponds in shape to the lower surface of the lining layer 7, i.e. to the surface 8 that is opposite to the surface that gets into contact with the molten matte phase. Moreover, the additional lining layer 12 has an essentially even thickness throughout the settler 3. The lining layer 7 and the additional lining layer 12 are also reinforced by an arched steel structure 13, which is provided with flow channels 14 for feeding air that is possibly used as the cooling gas to the inner parts of the steel structure 13. In addition, the steel structure 13 is made essentially uniform in thickness, at least in the part that includes flow channels 14, throughout the whole area of the suspension smelting furnace.

What is claimed is:

1. A bottom structure of a suspension smelting furnace having a reaction space where a sulfidic raw material containing metal is smelted in the presence of an oxygen-bearing gas and slag-forming agent, to render the metal into a form that is advantageous for further treatment, and where created molten phases are settled onto a bottom of the smelting furnace to separate the molten phases from each other, when the temperature of the molten phases is within the range 1150–1450° C., the bottom structure comprising:

at least one arched lining layer inclined in the longitudinal direction of the smelting furnace, a first arched lining layer having a first surface in contact with one or more of the molten phases, and a second surface opposite the first surface, the first arched lining layer being inclined in the longitudinal direction of the smelting furnace, forming the bottom structure thereof, and being made of a material having a thermal conductivity greater than 2 W/mK and a material porosity less than 20%, so that the temperature of the second surface is maintained below 800° C. in order to prevent a metallic phase, speise, having a low melting point, from penetrating through the lining layer.

2. A bottom structure according to claim 1, wherein the inclination of the lining layer that contacts the molten phase of the bottom structure is 0.1–4%.

3. A bottom structure according to claim 2, wherein the inclination of the lining layer that contacts the molten phase of the bottom structure is 0.2–2%.

4. A bottom structure according to claim 1, wherein between the lining layer that contacts the molten phase and the steel structure supporting the lining layer, there is arranged at least one additional lining layer.

5. A bottom structure according to claim 4, wherein the lining layer that contacts the molten phase, the steel structure supporting the lining layer and the additional lining layer is arched in shape.

6. A bottom structure according to claim 4, wherein the lining layer that contacts the molten phase, the steel structure supporting the lining layer and the additional lining layer, each have an essentially uniform thickness throughout the whole area of the suspension smelting furnace.

7. A bottom structure according to claim 1, wherein the steel structure supporting the bottom structure is provided with cooling.

* * * * *